United States Patent [19]

Lorento

[11] Patent Number: 4,805,685

[45] Date of Patent: Feb. 21, 1989

[54] MOLD FOR THE CONTINUOUS CASTING OF BEAM BLANKS

[75] Inventor: Donald P. Lorento, Ontario, Canada

[73] Assignee: SMS Concast, Montvale, N.J.

[21] Appl. No.: 152,886

[22] Filed: Feb. 5, 1988

Related U.S. Application Data

[63] Continuation-in-part of Ser. No. 834,935, Feb. 28, 1986, abandoned.

[51] Int. Cl.[4] ..... B22D 11/04

[52] U.S. Cl. ..... 164/418; 164/459

[58] Field of Search ..... 164/418, 459

[56] References Cited

FOREIGN PATENT DOCUMENTS 1091988 5/1984 U.S.S.R. ..... 164/418

*Primary Examiner*—Kuang Y. Lin

*Attorney, Agent, or Firm*—Peter K. Kontler; Tobias Lewenstein

[57] ABSTRACT

A mold for the continuous casting of beam blanks has a central casting passage bounded by a pair of parallel walls. On either side of the central casting passage is an expanding casting passage which widens in a direction away from the central casting passage and is bounded by a pair of inclined walls diverging from respective ones of the walls of the central casting passage. A terminal casting passage bounded by a pair of side walls parallel to the walls of the central casting passage is located outwardly adjacent to each expanding casting passage. The various casting passages cooperate to define a dogbone-shaped mold cavity. The inclined walls have an angle of inclination no smaller than arc tangent (y/z) where y is the distance from a point on an inclined wall to a transverse center line of the transverse cross section of the mold and z is the distance from such point to a longitudinal center line of the transverse cross section of the mold.

19 Claims, 1 Drawing Sheet

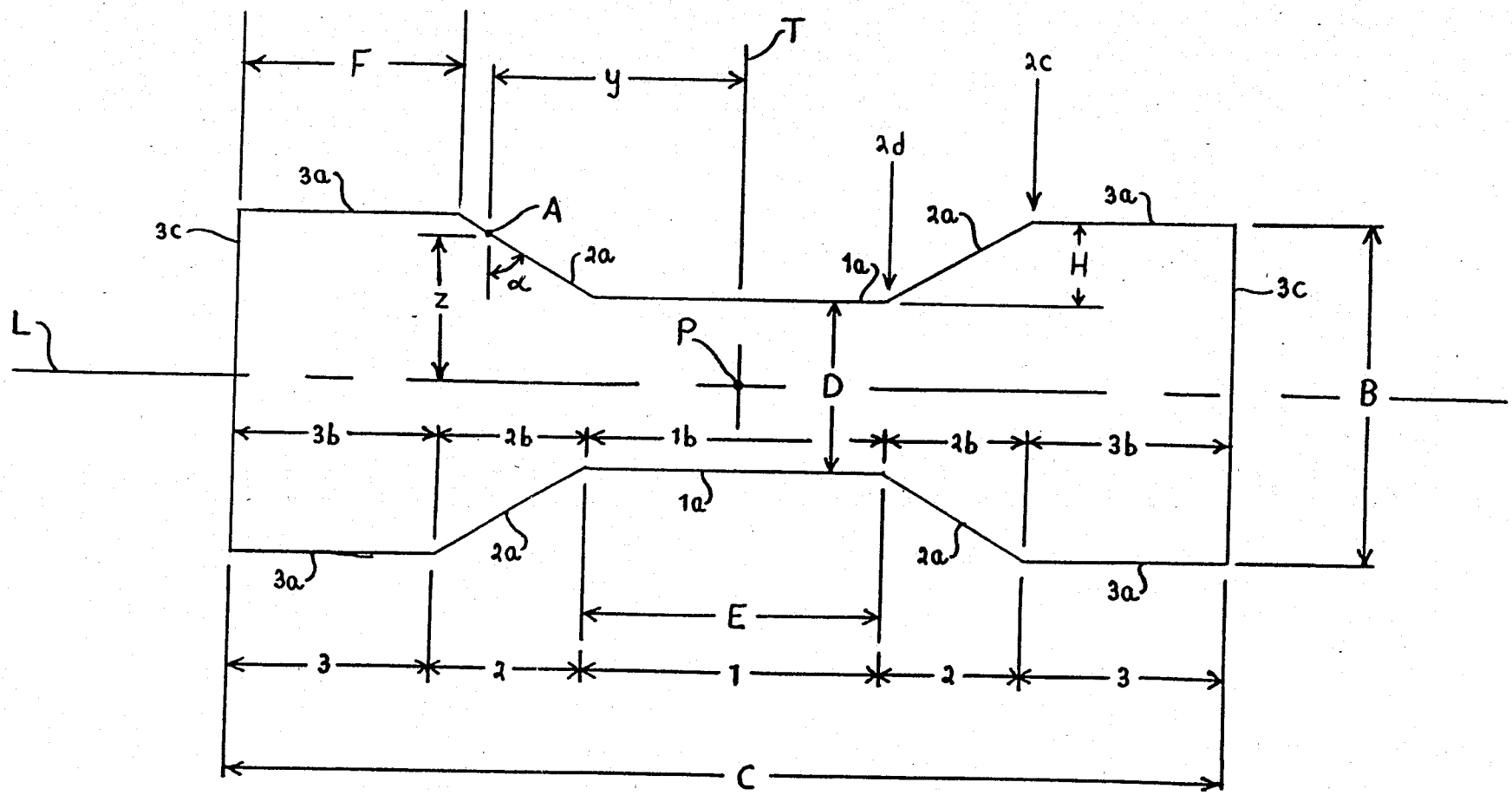
B
3c
3a
H
2c
2a
2d
1a
D
T
P
y
A
α
z
F
L
3b
2b
1b
E
1
2
3
C

MOLD FOR THE CONTINUOUS CASTING OF BEAM BLANKS

CROSS-REFERENCE TO RELATED APPLICATION

This application is a continuation-in-part of application Ser. No. 834,935 filed 28 Feburary 1986 by Donald P. Lorento for "MOLD FOR THE CONTINUOUS CASTING OF BEAM BLANKS", now abandoned.

BACKGROUND OF THE INVENTION

The invention relates generally to a continuous casting mold.

More particularly, the invention relates to a mold for the continuous casting of beam blanks.

In the steel industry, the term "beam blank" denotes a semifinished product having a dogbone-shaped cross section. A beam blank is converted from a semifinished product to a finished product by rolling. The finished product is an I-beam.

It is known to produce beam blanks by continuously casting a heat of steel into a continuous casting mold having a dogbone-shaped cross section. Continuous casting has the advantage that a series of beam blanks may be formed from the heat in a continuous operation. This enables energy savings to be achieved and also improves production.

A mold for the continuous casting of beam blanks typically has a central casting passage which is bounded by a pair of parallel walls and is designed to form the web of a beam blank. On either side of the central casting passage is a second casting passage which widens in a direction away from the central casting passage. These second or expanding casting passages are designed to form the inner flanges of a beam blank. Each of the expanding casting passages merges into a generally rectangular terminal casting passage designed to form the outer flange of a beam blank.

In current rolling mill practice, the expanding inner flanges of a beam blank define an angle of 19° with a normal to the longitudinal center line of the dogbone-shaped cross section. The inclined walls of the mold which bound the expanding casting passages must then intersect such a normal at the same angle. This presents a problem during continuous casting due to the fact that steel contracts as it cools and solidifies. Thus, when the steel adjacent to the walls of the mold solidifies, contraction of the steel causes the latter to come into frictional contact with the inclined walls of the mold. The friction increases the rate of wear of the inner surface of the mold so that the life of the mold is shortened. Furthermore, the friction adversely affects the surface quality of the beam blank. In addition, the friction increases the stress required to draw the beam blank out of the mold. The beam blank consists of a relatively large molten core and a relatively thin outer skin or shell upon leaving the mold, and the increased stress increases the likelihood of rupturing the skin. Rupture of the skin inside the mold is bad for the surface quality of the beam blank while rupture outside of the mold results in a "breakout", i.e., an escape of molten steel from the core of the beam blank.

The beam blank molds in use today also have another drawback associated with the fact that steel contracts as it cools and solidifies. Thus, as steel passes through a mold and is progressively cooled and solidified, the steel tends to pull farther and farther away from the walls of the mold thereby reducing heat transfer and decreasing the efficiency of the mold. To minimize reductions in heat transfer, it has become the practice to taper the casting passage so that this narrows in a direction from the inlet to the outlet of the mold. This at least partly compensates for contraction of the steel and allows relatively good heat transfer to be maintained. However, present beam blank molds cannot be effectively tapered.

OBJECTS AND SUMMARY OF THE INVENTION

It is an object of the invention to provide a mold for the continuous casting of beam blanks which enables friction to be reduced.

Another object of the invention is to provide a mold for the continuous casting of beam blanks which can be more effectively tapered.

The preceding objects, as well as others which will become apparent as the description proceeds, are achieved by the invention.

A continuous casting mold according to the invention comprises a first section which includes a pair of first walls defining a first casting passage having opposite open ends. The transverse cross section of the first section has a center, and substantially orthogonal longitudinal and transverse center lines which intersect at the center. The mold further comprises at least one expanding section to one side of the first section and including a pair of second walls defining at least one expanding casting passage which communicates with the first casting passage and has opposite open ends. The second walls are inclined relative to one another in such a manner that the expanding casting passage widens in a direction away from the first casting passage. The expanding casting passage includes a first end remote from, and a second end nearer to, the first casting passage and has a maximum width at the first end and a minimum width at the second end. Each of the second walls has a height at least approximately equal to one-half of the difference between the maximum and minimum widths and such height is no smaller than about 0.25 times the maximum width. At least one of the second walls has an angle of inclination no smaller than arc tangent (y/z) where:

y is the distance from a point on this wall to the transverse center line, and z is the distance from such point to the longitudinal center line.

The invention is based on the recognition that an increment of molten metal located adjacent to an inclined wall of a mold will attempt to move towards a central point, e.g., the center of the mold, as it contracts during solidification. The resultant of this contraction is given by arc tangent (y/z). Thus, by selecting the angle of inclination to be equal to or greater than arc tangent (y/z), frictional contact between the mold and the solidifying metal will be reduced. Furthermore, it then becomes possible to taper the mold properly which, in turn, will result in a significant increase in mold performance or efficiency.

The novel features which are considered as characteristic of the invention are set forth in particular in the appended claims. The continuous casting mold itself, however, both as to its construction and its mode of operation, together with additional features and advantages thereof, will be best understood from a perusal of the following detailed description of certain specific embodiments with reference to the accompanying drawing.

BRIEF DESCRIPTION OF THE DRAWING

The single FIGURE is a schematic plan view of a mold according to the invention for the continuous casting of beam blanks.

DESCRIPTION OF THE PREFERRED EMBODIMENTS

The FIGURE schematically illustrates a beam blank mold in accordance with the invention. The beam blank mold is designed for the continuous casting of strands having a dogbone-shaped cross section and, to this end, the mold is formed with a dogbone-shaped cavity. The mold has spaced longitudinal ends which are open so that molten metal, e.g., molten steel, may be continuously admitted into one end of the mold while an at least partially solidified strand is continuously withdrawn from the opposite end of the mold.

The mold has a central section 1 which includes a pair of essentially parallel side walls 1*a*. The walls 1*a* together define a central casting passage 1*b* having a generally rectangular cross section. The depth of the central section 1 is denoted by E while its width is denoted by D.

On either side of the central section 1 is an expanding section 2 which widens in a direction away from the central section 1. Each of the expanding sections 2 includes a pair of inclined walls 2*a* which are joined to respective ones of the walls 1*a* and diverge from the central section 1. Each pair of inclined walls 2*a* defines an expanding casting passage 2*b* which merges into the central casting passage 1*b*.

A terminal or end section 3 outwardly adjoins each of the expanding sections 2. Each terminal section 3 includes a pair of side walls 3*a* which are generally parallel to one another and to the walls 1*a* of the central section 1. Each wall 3*a* is fast with one of the walls 2*a* of an expanding section 2, and the respective pairs of walls 3*a* define terminal casting passages 3*b* of generally rectangular cross section. The casting passages 3*b* merge into the expanding casting passages 2*b*. Each pair of side walls 3*a* is bridged by an end wall 3*c* which is essentially perpendicular to the respective side walls 3*a*.

The terminal sections 3 have widths B. The overall depth of the mold is denoted by C.

The mold and its central section 1 have a common transverse center line T which is generally perpendicular to the walls 1*a* of the central section 1. Similarly, the mold and its sections 1–3 have a common longitudinal center line L which is substantially parallel to the side walls 1*a* of the central section 1 and the side walls 3*a* of the terminal sections 3, and is essentially perpendicular to the end walls 3*c* of the terminal sections 3. The transverse center line T and longitudinal center line L intersect at the center P of the mold and the central section 1.

The expanding sections 2 are mirror symmetrically arranged about the transverse center line T and the central section 1. The same holds true for the terminal sections 3. It will be observed that each of the walls 2*a* of the expanding sections 2 connects a side wall 3*a* of a terminal section 3 to a side wall 1*a* of the central section 1.

Each of the expanding casting passages 2*b* has a first end 2*c* remote from, and a second end 2*d* adjacent to, the passage 1*b*. The expanding casting passages 2*b* have their maximum widths at the ends 2*c* and their minimum widths at the ends 2*d*. The maximum width of each expanding casting passage 2*b* is equal to the width B of the terminal casting passages 3*b* whereas the minimum width of each expanding casting passage 2*b* is equal to the width D of the central casting passage 1*b*.

Each of the inclined walls 2*a* of the expanding casting passages 2*b* has a height H which is the length of the projection of an inclined wall 2*a* on a plane containing the transverse center line T and perpendicular to the longitudinal center line L. The height H is equal to one-half of the difference between the maximum and minimum widths of the expanding casting passages 2*b*, that is:

$$H = \frac{B - D}{2}. \tag{1}$$

For a beam blank mold, the height H is at least equal to 0.25B, i.e., 0.25 times the maximum width of the expanding casting passages 2*b*. Preferably, the height H does not exceed 0.45B.

Each of the casting passages 1*b*,2*b*,3*b* has spaced longitudinal ends which are open, and the various casting passages 1*b*,2*b*,3*b* cooperate to define the dogbone-shaped cavity of the mold.

The walls 1*a*,2*a*,3*a*,3*c* are composed of copper or a copper alloy in accordance with current practice.

An increment of metal located adjacent to any point A of an inclined wall 2*a* attempts to move towards the transverse center line T and the longitudinal center line L as it contracts during cooling. The resultant vector of the attempted contraction extends from the point A to the center P of the mold.

In a conventional beam blank mold, the angle alpha defined by an inclined wall 2*a* and a normal to the longitudinal center line L of the mold is so small, i.e., the inclined wall 2*a* is so steep, that an increment of metal adjacent to the inclined wall 2*a* is unable to move towards the center P of the mold. The walls 2*a* to the left of the center P extend to the left of the respective resultant contraction vectors while the walls 2*a* to the right of the center P extend to the right of the respective resultant contraction vectors. In either case, an increment of metal adjacent to an inclined wall 2*a* is prevented from moving in the direction of the resultant contraction vector because the inclined wall 2*a* is located between the metal and the vector. The attempt to move towards the center P of the mold brings the metal into frictional contact with the inclined wall 2*a* since one of the components of movement is towards the transverse center line T, and hence towards the inclined wall 2*a*.

According to the invention, the angle alpha defined by an inclined wall 2*a* and a normal to the longitudinal center line L of the mold is equal to or greater than $$\text{arc tangent } (y/z)$$

where

Y is the distance from any point A on an inclined wall 2*a* to the transverse center line T of the mold; and z is the distance from the point A to the longitudinal center line L of the mold.

When alpha=arc tangent (y/z) for an inclined wall 2*a*, the latter coincides with the resultant contraction vector so that an increment of metal adjacent to the inclined wall 2a l is free to move in the direction of such vector. The metal then does not move into the inclined wall 2a which reduces the friction between the metal and the inclined wall 2a. The same effect is obtained when alpha exceeds arc tangent (y/z). In this case, the inclined walls 2a to the left of the center P of the mold are disposed to the right of the respective resultant contraction vectors whereas the inclined walls 2a to the right of the center P are located to the left of the respective resultant contraction vectors. An increment of metal adjacent to an inclined wall 2a is accordingly not blocked from the respective resultant contraction vector by the wall 2a.

The angle alpha is not influenced by the magnitude of the contraction which may be controlled by adjusting the dimensions B, C and D.

Certain relationships as follows exist between the dimensions of a beam blank mold:

$$C=K1\cdot B \quad (2)$$

$$F=K2\cdot C \quad (3)$$

$$D=K3\cdot B \quad (4)$$

Here, F is the depth of the terminal casting passages 3b and K1, K2 and K3 are constants. The constant K2 normally lies in the range of 0.1 to 0.25 while the constant K3 normally lies in the range of 0.1 to 0.5.

The Machinery's Handbook (Industrial Press; New York, N.Y.) provides data on the dimensions of beams and such data can be used to show that the constant K1 may take on values from about 1 to about 3.5. The following Table, in which the first four columns contain data from the 21st (1979) edition of the Machinery's Handbook, demonstrates the values which may be assumed by the constant K1:

| Beam # | Depth, Inches | Flange Width, Inches | Unadjusted Ratio of Depth to Flange Width (K1) | Adjusted Ratio of Depth to Flange Width (K1) |
|---|---|---|---|---|
| W27 | 26.69 | 9.96 | 2.68 | 1.79 |
| W24 | 23.55 | 7.00 | 3.36 | 2.24 |
| W21 | 20.66 | 6.50 | 3.18 | 2.12 |
| W18 | 17.71 | 6.00 | 2.95 | 1.97 |
| W16 | 15.65 | 5.50 | 2.85 | 1.90 |
| W14 | 13.72 | 5.00 | 2.74 | 1.83 |
| W12 | 11.91 | 3.97 | 3.00 | 2.00 |
| W10 | 9.87 | 3.95 | 2.50 | 1.67 |
| W8 | 7.90 | 3.94 | 2.01 | 1.34 |
| W6 | 5.83 | 3.94 | 1.48 | 0.99 |
| S24 | 24.00 | 7.00 | 3.43 | 2.29 |
| S20 | 20.00 | 6.25 | 3.20 | 2.13 |
| S18 | 18.00 | 6.00 | 3.00 | 2.00 |
| S15 | 15.00 | 5.50 | 2.73 | 1.82 |
| S12 | 12.00 | 5.00 | 2.40 | 1.60 |
| S10 | 10.00 | 4.66 | 2.15 | 1.43 |
| S8 | 8.00 | 4.00 | 2.00 | 1.33 |
| S7 | 7.00 | 3.66 | 1.91 | 1.27 |

The first column designates the beam type. the second column indicates the depth (corresponding to in the FIGURE) of the most slender beam while the third column indicates the flange width (corresponding to B in the FIGURE) of the most slender beam. The fourth column represents the unadjusted ratio of the depth to the flange width and, for any beam, is simply the dimension of the second column divided by the dimension of the third column.

The dimensions in the third column are the finished dimensions of the beam, that is, the dimensions after rolling. In order to achieve the dimensions of the third column, it is the practice in the industry for the feed stock, i.e., the as-cast beam, to have a flange width which is 1.5 times greater than the flange width of the finished beam. The fifth column in the preceding Table shows the ratio of depth to flange width taking this adjustment into account. Thus, for any beam, the fifth column is the dimension of the second column divided by 1.5 times the dimension of the third column.

The numbers in both the fourth and fifth columns of the Table represent the ratio C/B so that, from Equation (2), it follows that the numbers in these two columns are possible values of the constant K1. The Table indicates that K1 can take on values of about 1 to about 3.5.

In theory, it is possible to continuously cast a beam to, or very nearly to, its final dimensions. The dimensions of the beam blank mold would then correspond to the final dimensions of the beam so that the depth, C, and flange width, B, of the mold would assume the values in the second and third columns of the Table. The constant K1 then ranges from about 1.5 to about 3.5.

Although it is theoretically possible to continuously cast a beam to, or very nearly to, its final dimensions, the technology required for this does not yet exist. Therefore, in accordance with the industry practice of using feed stock having a flange width which is 1.5 times greater than that of the finished beam, the beam blank molds currently employed in the industry likewise have a flange width, B, equal to 1.5 times the flange width of the finished beam. Such a beam blank mold has the depth shown in the second column of the Table and a flange width which is 1.5 times greater than the flange width indicated in the third column. The constant K1 here takes on values from about 1 to about 2.3.

The currently preferred range for the constant K1 is from about 1 to about 2.

The angle of inclination, alpha, of the inclined walls 2a can be calculated from the following equation:

$$\text{alpha-arc tangent } [0.5C-F]/0.5B$$

This equation makes it possible to establish upper and lower limits for alpha.

The maximum value of alpha is achieved under the following conditions:

a. The depth of the beam blank mold is the maximum available.

b. The constant K1 assumes its maximum value.

c. The constant K2 assumes its minimum value.

From the Table, it may be seen that the beam blank mold of maximum depth corresponds to Beam #W27. The depth of this beam is nominally 27 inches and this dimension is assumed for the depth of the beam blank mold, i.e., C=27 inches. Substituting this dimension in Equation (2) together with the maximum value of 3.5 for the constant K1, the flange width, B, of the mold is found to be 7.7 inches. Similarly, substituting the beam depth of 27 inches in Equation (3) together with the minimum value of 0.1 for the constant K2, the flange depth, F, works out to 2.7 inches. Using Equation (5), the maximum value of alpha can then be calculated as follows:

$$\text{alpha} = \text{arc tangent } [(0.5 \times 27) - 2.7]/(0.5 \times 7.7)$$
$$= \text{arc tangent } [13.5 - 2.7]/3.8 = \text{arc tangent } 2.8$$
$$= 70.4 \text{ degrees.}$$

The currently preferred maximum value of alpha is achieved under the following conditions:

a. The depth of the beam blank mold is the maximum available.

b. The constant K1 assumes its preferred maximum value.

c. The constant K2 assumes its minimum value.

The beam depth, C, and flange depth, F, are the same as in the preceding calculation. However, the flange width, B, is different because the preferred maximum value of K1 is 2. Substituting the beam depth of 27 inches in Equation (2) together with the preferred maximum value of 2 for the constant K1, the flange width, B, of the mold is now found to be 13.5 inches. From Equation (5), the currently preferred maximum value of alpha is then calculated as follows:

$$\text{alpha} = \text{arc tangent } [(0.5 \times 27) - 2.7]/(0.5 \times 13.5)$$
$$= \text{arc tangent } [13.5 - 2.7]/6.8 = \text{arc tangent } 1.6$$
$$= 58.0 \text{ degrees.}$$

The minimum value of alpha is achieved under the following conditions:

a. The depth of the beam blank mold is the minimum available.

b. The constant K1 assumes its minimum value.

c. The constant K2 assumes its maximum value.

The Table shows that the beam blank mold of minimum depth corresponds to Beam #W6. The depth of this beam is nominally 6 inches and this dimension is assumed here for the depth of the beam blank mold, i.e., C=6 inches. Substituting this dimension in Equation (2) together with the minimum value of 1 for the constant K1, the flange width, B, of the mold works out to 6 inches. In like manner, substituting the beam depth of 6 inches in Equation (3) together with the maximum value of 0.25 for the constant K2, the flange depth, F, is found to be 1.5 inches. Using Equation (5), the minimum value of alpha can now be calculated as follows:

$$\text{alpha} = \text{arc tangent } [(0.5 \times 6) - 1.5]/(0.5 \times 6)$$
$$= \text{arc tangent } [3 - 1.5]/3 = \text{arc tangent } 0.5$$
$$= 26.5 \text{ degrees.}$$

The angle of inclination, alpha, of the inclined walls *2a* may thus take on values between 26.5 degrees and 70.4 degrees. It is preferred, however, for alpha to lie in the range of 26.5 degrees to 58.0 degrees.

The mold of the invention makes it possible to produce a continuously cast beam blank which, upon leaving the mold, has a shell of increased thickness, strength and uniformity. This is due to the fact that the angle alpha in accordance with the invention results in reduced friction between the beam blank and the mold, and the fact that such angle alpha allows the dogbone-shaped cavity of the mold to be properly tapered.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A mold for the continuous casting of beam blanks, comprising a first section including a pair of first walls defining a first casting passage having opposite open ends, the transverse cross section of said first section having a center, and substantially orthogonal longitudinal and transverse center lines which intersect at said center; and at least one expanding section to one side of said first section, as considered in the direction of said longitudinal center line, and including a pair of second walls defining at least one expanding casting passage which communicates with said first casting passage and has opposite open ends, said second walls being inclined relative to one another in such a manner that said one expanding casting passage widens in a direction away from said first casting passage, and said one expanding casting passage including a first end remote from, and a second end nearer to, said first casting passage, said one expanding casting passage having a maximum width at said first end and a minimum width at said second end, and each of said second walls having a height, as measured in the direction of said tranverse celter line, no smaller than about 0.25 times said maximum width, and at least one of said second walls having an angle of inclination no smaller than arc tangent (y/z) where:

y is the distance from a point on said one second wall to said transverse center line, and z is the distance from said point to said longitudinal center line.

2. The mold of claim 1, comprising an additional expanding section which includes a pair of additional walls defining an additional expanding casting passage communicating with said first casting passage and having opposite open ends, said expanding sections being located on opposite sides of said first section, and said additional walls being inclined relative to one another in such a manner that said additional expanding casting passage widens in a direction away from said first casting passage, at least one of said additional walls having an angle of inclination no smaller than arc tangent (y/z).

3. The mold of claim 2, comprising at least one end section which is disposed on a side of said one expanding section remote from said first section, said one end section having a pair of side walls defining a terminal casting passage which communicates with said one expanding casting passage and has opposite open ends.

4. The mold of claim 3, comprising an additional end section which is disposed on a side of said additional expanding section remote from said first section, said additional end section having a pair of side walls defining an additional terminal casting passage which communicates with said additional expanding casting passage and has opposite open ends.

5. The mold of claim 4, wherein each of said second walls and each of said additional walls has an angle of inclination no smaller than arc tangent (y/z).

6. The mold of claim 4, wherein said casting passages together define a substantially dogbone-shaped cavity.

7. The mold of claim 4, wherein said end sections and said expanding sections are substantially symmetrically arranged about said first section.

8. The mold of claim 4, wherein each of said walls of said expanding sections joins one of said side walls to one of said first walls.

9. The mold of claim 4, wherein each of said end sections has an end wall which bridges the respective side walls.

10. The mold of claim 9, wherein said end walls are substantially normal to said longitudinal center line.

11. The mold of claim 4, wherein said first walls and said side walls are substantially parallel to said longitudinal center line.

12. The mold of claim 4, wherein said walls are constituted by copper or a copper alloy.

13. The mold of claim 2, wherein said additional expanding casting passage includes one end remote from, and another end nearer to, said first casting passage, said additional expanding casting passage having a maximum width at said one end and a minimum width at said other end, and each of said additional walls having a height, as measured in the direction of said transverse center line, no smaller than about 0.25 times the maximum width of said additional expanding casting passage.

14. The mold of claim 1, wherein said height is about 0.25 to about 0.45 times said maximum width.

15. The mold of claim 1, wherein said angle of inclination is no more than about 70.4 degrees.

16. The mold of claim 15, wherein said angle of inclination is no more than about 58.0 degrees.

17. The mold of claim 15, wherein said angle of inclination is no less than about 26.5 degrees.

18. The mold of claim 1, wherein said height is at least approximately equal to one-half of the difference between said maximum and minimum widths.

19. The mold of claim 13, wherein said height of said additional walls is at least approximately equal to one-half of the difference between the maximum and minimum widths of said additional expanding casting passage.

* * * * *